US005662989A

United States Patent [19]

Obata et al.

[11] Patent Number: 5,662,989

[45] Date of Patent: Sep. 2, 1997

[54] THERMAL TRANSFER SHEET

[75] Inventors: Hitoshi Obata; Masashi Narita, both of Tokyo, Japan

[73] Assignee: Dai Nippon Printing Co., Ltd., Japan

[21] Appl. No.: 608,214

[22] Filed: Feb. 28, 1996

Related U.S. Application Data

[63] Continuation of Ser. No. 168,257, Dec. 17, 1993, abandoned.

[30] Foreign Application Priority Data

Dec. 25, 1992 [JP] Japan ..... 4-359263

[51] Int. Cl.[6] ..... B41M 5/26

[52] U.S. Cl. ..... 428/212; 428/195; 428/484; 428/488.1; 428/488.4; 428/913; 428/914

[58] Field of Search ..... 428/195, 484, 428/488.1, 488.4, 913, 480, 212, 914

[56] References Cited

FOREIGN PATENT DOCUMENTS 0307819 3/1989 European Pat. Off. .

182194 10/1992 Japan ..... 428/195

OTHER PUBLICATIONS

Abstract of JP 62–152790; Koichi Toma, Canon Inc; Jul. 1987.

Abstract of JP 62–249789; Hisao Yaegashi; Canon Inc; Oct. 1987.

Journal of Imaging Science vol. 35, No. 6, Nov. 1991, T Maehashi, Study of a Thermal Transfer Multiprinting Process, pp. 387–393.

*Primary Examiner*—Pamela R. Schwartz

*Attorney, Agent, or Firm*—Parkhurst, Wendel & Burr, L.L.P.

[57] ABSTRACT

A thermal transfer sheet including a substrate film and a hot-melt ink layer including a first ink layer and a second ink layer laminated in that order on one surface of the substrate film. The first ink layer includes a wax and a colorant, and the second ink layer comprising a supercooling resin incompatible with the wax, and a colorant.

2 Claims, 1 Drawing Sheet

THERMAL TRANSFER SHEET

This is a Continuation of application Ser. No. 08/168.257 filed Dec. 17, 1993, now abandoned.

BACKGROUND OF THE INVENTION

The present invention relates to a thermal transfer sheet having a hot-melt ink layer that can be used a plurality of times with a printer for mainly printing character information.

A thermal transfer sheet comprising a substrate film and a hot-melt ink layer provided on one surface of the substrate film has hitherto been used as a thermal transfer recording medium for thermal printing, facsimile, etc. In the conventional thermal transfer sheet, paper having a thickness of about 10 to 20 μm, such as capacitor paper or paraffin paper, or a plastic film having a thickness of about 3 to 20 μm, such as a polyester film or a cellophane film, is used as a substrate film, and a hot-melt ink comprising a mixture of a wax with a colorant, such as a pigment or a dye, is coated on the substrate film to provide a hot-melt ink layer. The thermal transfer sheet is heated and pressed with a thermal head at a predetermined portion from the back surface of the substrate film to transfer the hot-melt ink layer at the predetermined portion corresponding to a printing portion to printing paper, thereby effecting printing.

In the above-described thermal transfer sheet, however, the hot-melt ink layer at its portion heated and pressed by the thermal head is entirely transferred to the printing paper by using the thermal transfer sheet only once, so that the number of times of printing with satisfactory results is only one in an identical portion, which leads to problems of low profitability due to large consumption of the thermal transfer sheet and high running cost.

For this reason, various thermal transfer sheets have been developed which could be used a plurality of times. Examples thereof include a thermal transfer sheet in which a transfer regulating layer comprising a thermoplastic resin is formed on the hot-melt ink layer to prevent the ink layer from being entirely transferred in the first printing; a thermal transfer sheet disclosed in Japanese Patent Laid-Open No. 165291/1985 in which a resin layer composed mainly of a polycaprolactone polymer is formed between the substrate film and the hot-melt ink layer; a thermal transfer sheet disclosed in Japanese Patent Laid-Open No. 11364/1988 in which the hot-melt ink layer at its portion heated and pressed with a thermal head through the substrate film gives rise to cohesive failure and is transferred to printing paper; a thermal transfer sheet disclosed in Japanese Patent Laid-Open No. 151483/1988 which comprises a first ink layer capable of being brought to a low-viscosity liquid upon heating and a second ink layer which is stickable to the first ink layer but cannot be brought to a low-viscosity liquid; and a thermal transfer sheet disclosed in Japanese Patent Laid-Open No. 16685/1989 which comprises a substrate film and, provided on the substrate film in the following order, a porous ink layer and an ink layer having a supercooling property.

However, all the above-described thermal transfer sheets have a problem that although the print density in the first printing is high, the print density in the second or later printing is rapidly lowered.

On the other hand, a two-color type thermal transfer material having a first ink layer and a second ink layer having a supercooling property is disclosed in Japanese Patent Laid-Open No. 152790/1987 and Japanese patent Laid-Open No. 249789/1987 although it does not aim to be used a plurality of times.

However, in the thermal transfer sheet provided with a second ink layer having a supercooling property simply laminated onto a first ink layer, the second ink layer is entirely transferred in the first printing, and the first ink layer is entirely transferred in the second printing, so that printing can be effected only twice at best.

Further, Japanese Patent Laid-Open No. 105514/1983 discloses a thermal transfer sheet having a hot-melt ink layer composed mainly of polycaprolactone. The melt Viscosity of the supercooling polycaprolactone as the main component is as high as 8000 to 15000 mPas, so that it is difficult to transfer the ink during printing, which gives rise to a problem that no good printing sensitivity can be obtained.

Under these circumstances, the present invention has been made, and an object of the present invention is to provide a thermal transfer sheet that can exhibit a high printing sensitivity and provide a homogeneous image even when it is used a plurality of times, and particularly to solve the problem of the conventional thermal transfer sheet for repeated use that the printing sensitivity of a print pattern, which is printed with a low printing energy, such as character information, is inferior to that of a printing ribbon for single printing.

DISCLOSURE OF THE INVENTION

In order to attain the above-described object, the thermal transfer sheet of the present invention comprises a substrate film and a hot-melt ink layer comprising a first ink layer and a second ink layer laminated in that order on one surface of said substrate film, said first ink layer comprising a wax and a colorant, said second ink layer comprising a supercooling resin incompatible with said wax and a colorant.

As described above, according to the present invention, when a second ink layer is provided on a first ink layer, since a pressure is applied with a platen roll to an image receiving layer and a thermal transfer sheet in contact with each other during heating for printing with a thermal head, the second ink layer and the first ink layer are melted and mixed with each other. In this case, since the second ink layer contains a supercooling resin incompatible with the wax contained in the first ink layer, the first ink layer and the second ink layer are mixed with each other in such a manner that they give rise to fine layer separation. Therefore, the first ink layer and the second ink layer are not completely compatibilized with each other, and a small amount of the first ink layer is mixed with the second ink layer and vice versa. Therefore, the amount of the ink of the first ink layer decreases with increased distance from the substrate film, while the amount of the ink of the second ink layer increases with increased distance from the substrate film.

The supercooling component of the second ink layer has a low solidifying point and is in a molten state also in the stage of peeling. On the other hand, the first ink layer has a high solidifying point and is in a molten state in the stage of peeling. Therefore, when peeling is effected after the completion of printing, the cohesive force becomes lowest at a portion far from the substrate film, that is, a portion where the amount of the second ink layer containing the supercooling component is largest, so that peeling occurs at that portion.

Also in the second or later printing, the cohesive force becomes lowest at a portion far from the substrate film, so that printing can be effected a plurality of times to form a clear print at a homogeneous print density. Since the main components of the first and second ink layers are incompatible with each other, a change in thermal properties, such as melting point, solidifying point and melt viscosity, attributable to compatibilization can be prevented, and a homogeneous print quality can be provided even when printing is effected a plurality of times.

BEST MODE FOR CARRYING OUT THE INVENTION

Preferred embodiments of the present invention will now be described with reference to the accompanying drawings.

Figure 1:
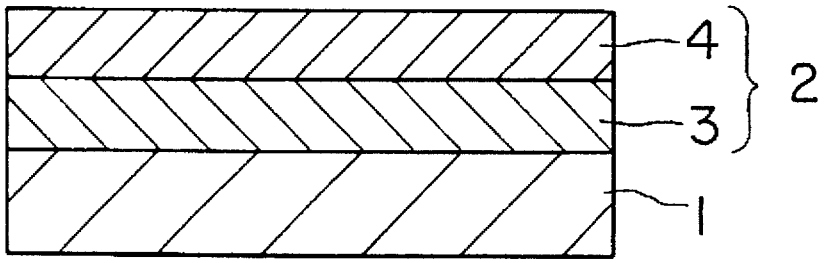
FIG. 1 is a cross-sectional view of the thermal transfer sheet of the present invention.

FIG. 1 is a cross-sectional view of the thermal transfer sheet of the present invention.

As shown in FIG. 1, the thermal transfer sheet of the present invention comprises a substrate film 1 and a hot-melt ink layer comprising a first ink layer 3 and a second ink layer 4 laminated in that order on one surface of the substrate film.

Figure 2:
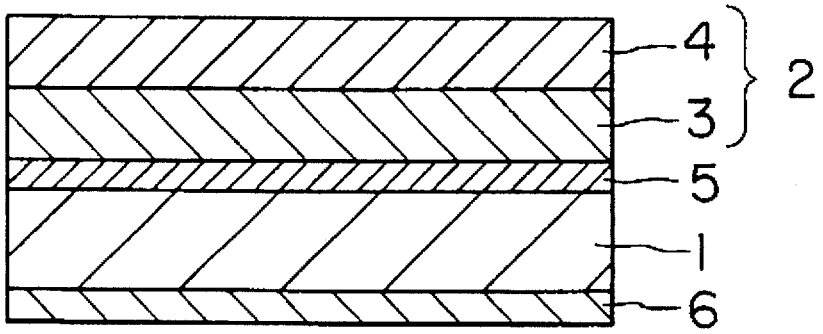
FIG. 2 is a cross-sectional view of an application example of the thermal transfer sheet of the present invention.

FIG. 2 shows an application example of the thermal transfer sheet of the present invention, and in the thermal transfer sheet of the present invention, if necessary, a primer layer 5 for imparting an adhesive property may be provided between the substrate film 1 and the hot-melt ink layer 2 and, further, a back surface layer 6 may be provided on the other surface of the substrate film 1.

Any substrate film used in the conventional thermal transfer medium, as such, may be used as the substrate film in the thermal transfer sheet of the present invention. Further, use may be made of other substrate films, and the substrate film is not particularly limited.

Specific preferred examples of the substrate film include plastics, such as polyesters, polypropylene, cellophane, polycarbonate, cellulose acetate, polyethylene, polyvinyl chloride, polystyrene, nylon, polyimides, polyvinylidene chloride, polyvinyl alcohol, fluororesins, chlorinated rubber and ionomers, paper, such as capacitor paper and paraffin paper, and nonwoven fabrics. Further, it is also possible to use a laminate comprising any combination of the above-described substrate films.

Although the thickness of the substrate film may be varied so as to have proper strength and heat conductivity according to the material, it is generally in the range of from about 2 to 25 μm.

A slip layer may be provided on the back surface of the substrate film for the purpose of preventing the sticking of the substrate film on the thermal head and, at the same time, improving the slip property.

A layer comprising a resin and, added thereto, a lubricant, a surfactant, an inorganic particle, an organic particle, a pigment, etc. is favorably used as the slip layer.

In the thermal transfer sheet of the present invention, the thickness of the hot-melt ink layer 2 provided on one surface of the substrate film is preferably in the range of from 4 to 12 μm, more preferably in the range of from 5 to 8 μm. When it is less than 5 μm, the print density often becomes unsatisfactory. On the other hand, when it is more than 8 μm, the print density often lowers.

The first ink layer is composed mainly of a wax. The wax content of the ink layer is preferably 50 to 90 parts by weight, more preferably 40 to 70 parts by weight. When it is less than 40 parts by weight, the print density often becomes unsatisfactory. On the other hand, when it is more than 70 parts by weight, the print density often becomes lower when increasing the number of times of printing. The thickness of the first ink layer is preferably in the range of from 2 to 6 μm, more preferably in the range of from 3 to 5 μm. When it is less than 3 μm, there is a possibility that no satisfactory print density can be obtained when increasing the number of times of printing. On the other hand, when it is more than 5 μm, the print density often lowers.

The first ink layer may comprise, besides the wax, 5 to 20 parts by weight of a thermoplastic resin as a binder, such as EVA or EAA. EVA is particularly preferred from the viewpoint of improving the fixability of the print and improving the dispersibility of carbon black.

An antioxidant may be added as an additive in an amount of 0.5 to 1 part by weight to the first ink layer. The addition of the antioxidant is preferred particularly from the viewpoint of the stability of the ink.

The second ink layer is composed mainly of a supercooling resin, and the content of the supercooling resin in the ink layer is preferably in the range of from 50 to 90 parts by weight, more preferably in the range of from 65 to 80 parts by weight. When it is less than 65 parts by weight, the supercooling property is unsatisfactory, so that there is a possibility that printing cannot be effected a plurality of times. On the other hand, when it is more than 80 parts by weight, the print density often lowers. The thickness of the second ink layer is preferably in the range of from 2 to 5 μm, more preferably in the range of from 3 to 4 μm. When it is less than 3 μm, there is a possibility that the print density becomes unsatisfactory with increasing the number of times of printing. On the other hand, when it exceeds 4 μm, the print density often lowers.

The second ink layer may comprise, besides the supercooling resin, 5 to 20 parts by weight of EVA. The addition of EVA is particularly preferred from the viewpoint of improving the stability of the print.

Examples of the wax component used as the binder in the first ink layer include microcrystalline wax, carnauba wax and paraffin wax. Further examples of the wax usable in the binder include various waxes, such as Fischer-Tropsch wax, various types of low-molecular weight polyethylene, Japan wax, beeswax, spermaceti, insect wax, wool wax, shellac wax, candelilla wax, petrolatum, polyester wax, partially modified wax, fatty acid esters and fatty acid amides. Among them, those having a solidifying point in the range of from 50° to 70° C. are particularly preferred. When the solidifying point is below 50° C., there occurs a problem of storage stability, while when it exceeds 70° C., the sensitivity becomes unsatisfactory.

Further, the wax preferably has a melt viscosity at 100° C. in the range of from 10 to 200 mPas. When the melt viscosity is less than 10 mPas, blurring and other unfavorable phenomena occur in the print. On the other hand, when it is more than 200 mPas, the transfer becomes unsatisfactory.

The colorant can be properly selected from known organic or inorganic pigments or dyes. For example, colorants having a sufficient color density and not causing discoloration and fading upon exposure to light, heat, etc. are preferred. Further, the colorant may be a substance that develops a color upon heating or a substance that develops a color upon contact with a component coated on a material to which an image is to be transferred. Further, the color of the colorant is not limited to cyan, magenta, yellow and black, and use may be made of colorants having various colors.

When the adhesion between the substrate film 1 and the first ink layer 3 is insufficient, the first ink layer 3 can be formed through a primer layer 5. The primer layer may comprise an acrylic resin, a nylon resin, a vinyl chloride/vinyl acetate copolymer, a polyester resin, a urethane resin, EVA, EAA or the like or a combination of a plurality of the above resins. The thickness of the primer layer is preferably in the range of from 0.1 to 1 μm.

In the second ink layer, the supercooling resin is a resin incompatible with the wax used in the first ink layer. The incompatible relationship is such that when the wax and the supercooling resin are fused by heating at 120° C. and then cooled to room temperature, they are separated from each other. Further, the incompatible relationship include such a relationship that they remain incompatible with each other when heated at 120° C.

The supercooling resin preferably has a melting point in the range of from 58° to 75° C. and a solidifying point in the range of from 20° to 55° C. The melting point and the solidifying point have an effect on the thermal behavior of the second ink layer when heated with a thermal head. When the melting point is below the above range, there occurs a problem of storage stability, while when it exceeds the above range, the sensitivity becomes unsatisfactory. When the solidifying point is below the above range, blocking occurs during winding.

The supercooling resin has an average molecular weight in the range of from 1000 to 40000, preferably in the range of form 4000 to 30000. When the average molecular weight is less than 4000, the melting point becomes so low that there occurs a problem of storage stability. On the other hand, when it exceeds 30000, the melt viscosity is so high that the transferability is lowered. The melt viscosity at 100° C. is in the range of from 100 to 30000 mPas, preferably in the range of from 100 to 20000 mPs. When it is less than 100, unfavorable phenomena, such as blur of the ink, occur, while when it exceeds 20000, the transferability lowers.

Specific examples of supercooling resins considered usable in the present invention include linear saturated polyesters comprising butanediol as the alcohol moiety and sebacic acid, terephthalic acid or nonanoic acid as the acid moiety, polyesters, such as polycaprolactone, polyethylene glycol, the above resins modified with a silicone and polyamide resins.

In the ink layer 2, these supercooling resins may be used in combination, and combined use of those of the same kind with varied molecular weights is particularly preferred. In this case, in the formation of an ink layer, necessary melting point, solidifying point and melt viscosity suited to a printer used can be easily provided.

Examples of the colorant used in the second ink layer include those used in the first ink layer.

The above ink layers are formed as follows. At the outset, a coating solution prepared by dissolving the wax component as the binder of the first ink layer by heating and dispersing a colorant in the solution is coated on a substrate by hot-melt coating to form a first ink layer, and a coating solution prepared by dissolving a supercooling resin as the binder of the second ink layer and a colorant in a solvent having a low capability of dissolving the wax as the main component of the first ink layer, such as methyl ethyl ketone or ethyl acetate, is then coated thereon by gravure coating and dried to form a second ink layer.

The supercooling resin used in the second ink layer, as such, is too viscous to be coated by hot-melt coating, and when it is melted once, a lot of time is required for solidification. For this reason, the ink is used in the form of a solution of the resin dissolved in a solvent. In this case, when use is made of a solvent having a low capability of dissolving the wax as the main component of the first ink layer, the form of the first ink layer can be maintained during the formation of the second ink layer by coating, which enables coating to be stably effected.

In the thermal transfer sheet of the present invention, when a second ink layer is provided on a first ink layer, since a pressure is applied with a platen roll to an image receiving paper and a thermal transfer sheet in contact with each other during heating for printing with a thermal head, the second ink layer and the first ink layer are melted and mixed with each other. In this case, since the second ink layer contains a supercooling resin incompatible with a wax contained in the first ink layer, the first ink layer and the second ink layer are mixed with each other in such a manner that they give rise to fine layer separation. Therefore, the first ink layer and the second ink layer are not completely compatibilized with each other, and a small amount of the first ink layer is mixed with the second ink layer and vice versa. Therefore, the amount of the ink of the first ink layer decreases with increased distance from the substrate film, while the amount of the ink of the second ink layer increases with increased distance from the substrate film.

The supercooling component of the second ink layer has a low solidifying point and is in a molten state also in the stage of peeling. On the other hand, the first ink layer has a high solidifying point and is in a molten state in the stage of peeling. Therefore, when peeling is effected after the completion of printing, the cohesive force becomes lowest at a portion far from the substrate film, that is, where the amount of the second ink layer containing the supercooling component is largest, so that peeling occurs at that portion.

Also in the second or later printing, the cohesive force becomes lowest at a portion far from the substrate film, so that printing can be effected a plurality of times to form a clear print at a homogeneous print density. Since the main components of the first and second ink layers are incompatible with each other, a change in thermal properties, such as melting point, solidifying point and melt viscosity, attributable to compatibilization can be prevented, and a homogeneous print quality can be provided even when printing is effected a plurality of times.

EXAMPLES

The present invention will now be described in more detail with reference to the following Examples and Comparative Examples. In the Examples and Comparative Examples, "parts" or "%" is by weight unless otherwise specified.

Example 1

At the outset, inks having the following compositions for an adhesive layer, a first ink layer and a second ink layer were prepared.

| Composition of ink for adhesive layer | |
|---|---|
| Melamine resin filler (Epostar S manufactured by Nippon Shokubai Kagaku Kogyo Co., Ltd.) | 15 parts |
| Polyester resin (Elitel 3200 manufactured by Unichika Ltd.) | 15 parts |
| Toluene | 48 parts |
| MEK | 22 parts |
| **Composition of ink for first ink layer** | |
| Carbon black (Diablack manufactured by Mitsubishi Kasei Corp.) | 10 parts |
| Ethylene/vinyl acetate copolymer | 10 parts |
| Carnauba wax | 9 parts |
| Paraffin wax (solidifying point: 62° C., melt viscosity; 80 mPas) | 70 parts |
| **Composition of ink for second ink layer** | |
| Carbon black (Diablack manufactured by Mitsubishi Kasei Corp.) | 12 parts |
| Ethylene/vinyl acetate copolymer | 6.6 parts |
| Saturated linear polyester as supercooling component (solidifying point: 30° C., molecular weight: 5000) | 80.4 parts |
| MEK | 276 parts |

Then, a back surface layer was formed on one surface of a 6 μm-thick polyethylene film as a substrate film, and the ink for a primer layer, the ink for a first ink layer and the ink for a second ink layer were coated in that order on the other surface of the substrate film, and the coatings were dried to provide a thermal transfer sheet of the present invention. In the formation of the thermal transfer sheet, the primer layer and the second ink layer were formed by coating the ink for a primer layer and the ink for a second ink layer respectively at coverages of 0.3 g/m$^2$ on a dry basis and 2 g/m$^2$ on a dry basis by gravure coating, and the first ink layer was formed by coating the ink for a first ink layer at a coverage of 3 g/m$^2$ on a dry basis by hot melt roll coating.

Example 2

A thermal transfer sheet was formed in the same manner as that of Example 1, except that the coverage of the second ink layer was 1 g/m$^2$.

Example 3

A thermal transfer sheet was formed in the same manner as that of Example 1, except that the coverage of the second ink layer was 3 g/m$^2$.

Comparative Example 1

A thermal transfer sheet was formed in the same manner as that of Example 1, except that after the primer layer was formed on the substrate film, the first ink layer alone was formed thereon at a coverage of 5 g/m$^2$.

Comparative Example 2

A thermal transfer sheet was formed in the same manner as that of Example 1, except that after the primer layer was formed on the substrate film, the second ink layer alone was formed thereon at a coverage of 5 g/m$^2$.

Comparative Example 3

A thermal transfer sheet was formed in the same manner as that of Example 1, except that a coating solution having the following composition for a resin layer was coated on the substrate film at a coverage of 2 g/m$^2$ to form a resin layer and a hot melt coating composition having the following composition for an ink layer was coated thereon at a coverage of 3 g/m$^2$ to form an ink layer.

| Composition of coating solution for resin layer | |
|---|---|
| Polycaprolactone (Placcel H-7 manufactured by Daicel Chemical Industries, Ltd.) | 100 parts |
| Toluene | 1000 parts |
| **Composition of hot melt coating composition for ink layer** | |
| Microcrystalline wax | 60 parts |
| Carnauba wax | 10 parts |
| Ethylene/ethyl acrylate | 10 parts |
| Carbon black | 20 parts |

Comparative Example 4

A thermal transfer sheet was formed in the same manner as that of Example 1, except that a coating solution having the following composition for forming a first hot-melt layer, a coating solution having the following composition for forming a first hot-softening coloring layer, a coating solution having the following composition for forming a second hot-melt layer and a coating solution having the following composition for forming a second hot-softening coloring layer were coated in that order on the substrate film respectively at coverages of 2 g/m$^2$, 4 g/m$^2$, 2 g/m$^2$ and 4 g/m$^2$, and dried.

| Composition of coating solution for forming first hot-melt layer | |
|---|---|
| EVA (Sumitate KC-10 manufactured by Sumitomo Chemical Co., Ltd.) | 6 parts |
| Polyethylene (Hi-wax 220P manufactured by Mitsui Petrochemical Industries, Ltd.) | 6 parts |
| Toluene | 250 parts |
| **Composition of coating solution for forming first hot-softening layer** | |
| EVA (Evaflex 410 manufactured by Du Pont-Mistui Polychemicals Co., Ltd.) | 5 parts |
| Polyethylene oxide (PE-D521 manufactured by Hoechst) | 4 parts |
| Vinyl chloride/vinyl acetate copolymer (VYHH manufactured by union Carbide Corporation) | 1 part |
| Carbon black (Diablack manufactured by Mitsubishi Kasei Corp.) | 2 parts |
| Toluene | 85 parts |
| MEK | 15 parts |

-continued

| Composition of coating solution for forming second hot-melt layer | |
|---|---|
| Polyamide resin (Versamid 940 manufactured by Henkel Hakusui Corp.) | 5 parts |
| 1,2-Hydroxystearic acid | 5 parts |
| isopropyl alcohol | 90 parts |
| **Composition of coating solution for forming second hot-softening layer** | |
| EVA (Evaflex 410 manufactured by Du Pont-Mistui Polychemicals Co., Ltd.) | 5 parts |
| Polyethylene oxide (PE-D521 manufactured by Hoechst) | 4 parts |
| Vinyl chloride/vinyl acetate copolymer (VYHH manufactured by Union Carbide Corporation) | 1 part |
| Carbon black (Diablack manufactured by Mitsubishi Kasei Corp.) | 2 parts |
| Toluene | 85 parts |
| MEK | 15 parts |

Comparative Example 5

A thermal transfer sheet was formed in the same manner as that of Example 1, except that a coating solution having the following composition for forming a porous ink layer and a coating solution having the following composition for forming a supercooling ink layer were coated in that order on the substrate film respectively at coverages of 8 g/m$^2$ and 4 g/m$^2$ and dried.

| Composition of coating solution for forming porous ink layer | |
|---|---|
| Carbon black (Disblack manufactured by Mitsubishi Kasei Corp.) | 15 parts |
| Deodorization refined candelilla wax | 25 parts |
| Paraffin wax (HNP-11 manufactured by Nippon Seiro Co., Ltd.) | 20 parts |
| EVA (Sumitate KC-10 manufactured by Sumitomo Chemical Co., Ltd.) | 7 parts |
| Vinyl chloride/vinyl acetate copolymer (VYHH manufactured by union Carbide Corporation) | 30 part |
| Toluene | 85 parts |
| MEK | 15 parts |
| **Composition of coating solution for forming supercooling ink layer** | |
| Carbon black (Diablack manufactured by Mitsubishi Kasei Corp.) | 20 parts |
| 1,3-Diphenoxy-2-propanol (supercooling component) | 30 parts |
| Toluene | 20 parts |

Comparative Example 6

A thermal transfer sheet was formed in the same manner as that of Example 1, except that a coating solution having the following composition for forming an ink layer was coated on the substrate film respectively at a coverage of 8 g/m$^2$ and dried.

| Composition of coating solution for forming ink layer | |
|---|---|
| Carbon black (Diablack manufactured by Mitsubishi Kasei Corp.) | 4 parts |
| Polycaprolactone (molecular weight: 10000) (Placcel H-1 manufactured by Daicel Chemical Industries, Ltd.) | 12 parts |
| Polycaprolactone (molecular weight: 70000) (Placcel H-7 manufactured by Daicel Chemical industries, Ltd.) | 3 parts |
| MEK | 70 parts |

The thermal transfer sheets of the present invention and the comparative thermal transfer sheets were used to print a print pattern of letters on wood free paper (Bekk smoothness: 50–80 sec) under the following conditions with a simulator manufactured by the company by which the inventors of the present invention are employed to evaluate the multiple printing performance in terms of the number of times of successful printing and character sensitivity.

Printing speed: 5 in./sec
Printing pressure: 5 kgf/line
Thermal head:
glaze length at thick film portion: 4 in.
dot density: 8 dots/mm
Distance from the thermal head to peeling point: 2 mm
Printing energy: 0.19–0.5 mJ/dot(hysteresis controlled)

TABLE 1

| | Ex. 1 | Ex. 2 | Ex. 3 | Comp. Ex. 1 | Comp. Ex. 2 |
|---|---|---|---|---|---|
| Number of times of printing with satisfactory results | 5 | 4 | 7 | 1 | 5 |
| Character sensitivity | ○ | ○ | ○ | ○ | X |

| | Comp. Ex. 3 | Comp. Ex. 4 | Comp. Ex. 5 | Comp. Ex. 6 |
|---|---|---|---|---|
| Number of times of printing with satisfactory results | 1 | 2 | 5 | 5 |
| Character sensitivity | ○ | X | X | X |

(○: Good, X: Failure)

As described above, according to the present invention, when a second ink layer is provided on a first ink layer, since a pressure is applied with a platen roll to an image receiving layer and a thermal transfer sheet in contact with each other during heating for printing with a thermal head, the second ink layer and the first ink layer are melted and mixed with each other. In this case, since the second ink layer contains a supercooling resin incompatible with a wax contained in the first ink layer, the first ink layer and the second ink layer are mixed with each other in such a manner that they give rise to fine layer separation. Therefore, the first ink layer and the second ink layer are not completely compatibilized with each other, and a small amount of the first ink layer is mixed with the second ink layer and vice versa. Therefore, the amount of the ink of the first ink layer decreases with increased distance from the substrate film, while the amount of the ink of the second ink layer increases with increased distance from the substrate film.

The supercooling component of the second ink layer has a low solidifying point and is in a molten state also in the stage of peeling. On the other hand, the first ink layer has a high solidifying point and is in a molten state in the stage of peeling. Therefore, when peeling is effected after the completion of printing, the cohesive force becomes lowest at a portion far from the substrate film, that is, where the amount of the second ink layer containing the supercooling component is largest, so that peeling occurs at that portion.

Also in the second or later printing, the cohesive force becomes lowest at a portion far from the substrate film, so that printing can be effected a plurality of times to form a clear print at a homogeneous print density. Since the main components of the first and second ink layers are incompatible with each other, a change in thermal properties, such as melting point, solidifying point and melt viscosity, attributable to compatibilization can be prevented, and a homogeneous print quality can be provided even when printing is effected a plurality of times.

What is claimed is:

1. A thermal transfer sheet usable a plurality of times with a printer, comprising:

a substrate film;

a first ink layer formed on said substrate film, said first ink layer comprising a colorant and a wax; and a second ink layer formed on said first ink layer, said second ink layer comprising a colorant and a supercooling resin incompatible with said wax of said first ink layer, the incompatible relationship between said wax of said first layer and said supercooling resin of said second ink layer being such that, when said wax and said supercooling resin are fused by heating at 120° C. and then cooled to room temperature, said wax and said supercooling resin are separated from each other, whereby said first ink layer and said second ink layer are mixed with each other in such a manner that they give rise to fine phase separation upon heating for printing, said first ink layer colorant and said second ink layer colorant having the same color, said supercooling resin consisting of a saturated linear polyester resin having a solidifying point of about 20° to about 55° C. and a melt viscosity at 100° C. of about 100 to about 20,000 mPas, the content of said supercooling resin in the second ink layer being in the range of from about 65 to about 80 parts by weight.

2. The thermal transfer sheet of claim 1, wherein said plurality of times is at least three.

* * * * *